US010376026B2

(12) United States Patent
Zhang et al.

(10) Patent No.: US 10,376,026 B2
(45) Date of Patent: Aug. 13, 2019

(54) DIAMOND WITH EIGHTY-ONE FACETS HAVING A TEN HEARTS AND TEN ARROWS INNER STRUCTURE AND A CUTTING METHOD THEREOF

(71) Applicant: SHENZHEN PERFECT LOVE DIAMOND CO., LTD., Shenzhen (CN)

(72) Inventors: Kunzhi Zhang, Anqiu (CN); Feng Zhang, Anqiu (CN)

(73) Assignee: SHENZHEN PERFECT LOVE DIAMOND CO., LTD., Shenzhen (CN)

( * ) Notice: Subject to any disclaimer, the term of this patent is extended or adjusted under 35 U.S.C. 154(b) by 0 days.

(21) Appl. No.: 15/724,247

(22) Filed: Oct. 3, 2017

(65) Prior Publication Data

US 2018/0020790 A1 Jan. 25, 2018

Related U.S. Application Data

(63) Continuation-in-part of application No. 14/437,830, filed as application No. PCT/CN2013/087111 on Nov. 14, 2013, now abandoned.

(30) Foreign Application Priority Data

Feb. 26, 2013 (CN) ..... 2013 1 0060336

(51) Int. Cl.
*A44C 17/00* (2006.01)

(52) U.S. Cl.
CPC ..... *A44C 17/001* (2013.01)

(58) Field of Classification Search
CPC ..... A44C 17/001
(Continued)

(56) References Cited

U.S. PATENT DOCUMENTS 4,219,199 A 8/1980 Okuda ..... 274/38
D616,785 S 6/2010 Slowinski ..... D11/90
(Continued)

FOREIGN PATENT DOCUMENTS

CN 201108098 Y 9/2008
CN 102078054 A 6/2011
(Continued)

OTHER PUBLICATIONS

Chen, Zhonghui, "Diamond Grading Manual" British Gemstone Association and Gem Testing Laboratory, China University of Geosciences Press, pp. 45-66.

*Primary Examiner* — Jack W Lavinder
(74) *Attorney, Agent, or Firm* — Brinks Gilson & Lione

(57) ABSTRACT

The invention relates to the field of jewelry, specifically to a diamond with eighty-one facets having a ten hearts and ten arrows inner structure and a cutting method thereof. The diamond comprises a table facet, ten main crown facets and ten main pavilion facets; a crown star facet is disposed at a junction of two adjacent main crown facets with the table facet; a crown small facet is disposed at a junction of two adjacent main crown facets with the crown star facet; a small sector is disposed at a junction of the main crown facet with the crown small facet; and two main pavilion facet auxiliary surfaces are disposed at a junction of two adjacent main pavilion facets. The cutting method comprises a division of a pavilion, a crown and a girdle, the pavilion cutting and the crown cutting. The shaped diamond has very good brilliance, fire and sparkle.

10 Claims, 12 Drawing Sheets

(58) Field of Classification Search
USPC ..... 63/32; D11/90
See application file for complete search history.

(56) References Cited

U.S. PATENT DOCUMENTS

| | | | | |
|---|---|---|---|---|
| D632,205 | S | 2/2011 | Mehta | D11/90 |
| 2005/0011226 | A1 | 1/2005 | So | 63/32 |
| 2006/0137674 | A1 | 6/2006 | Aoyagi | 125/30.01 |
| 2009/0056374 | A1 | 3/2009 | Abate | 63/26 |
| 2014/0026616 | A1 | 1/2014 | Rydlewicz | 63/32 |

FOREIGN PATENT DOCUMENTS

| | | | |
|---|---|---|---|
| CN | 202697980 | U | 1/2013 |
| CN | 103126215 | A | 6/2013 |
| CN | 203220016 | U | 10/2013 |
| CN | 102238885 | B | 2/2015 |
| EP | 1 110 472 | A1 | 6/2001 |
| JP | 2010-201043 | A | 9/2010 |

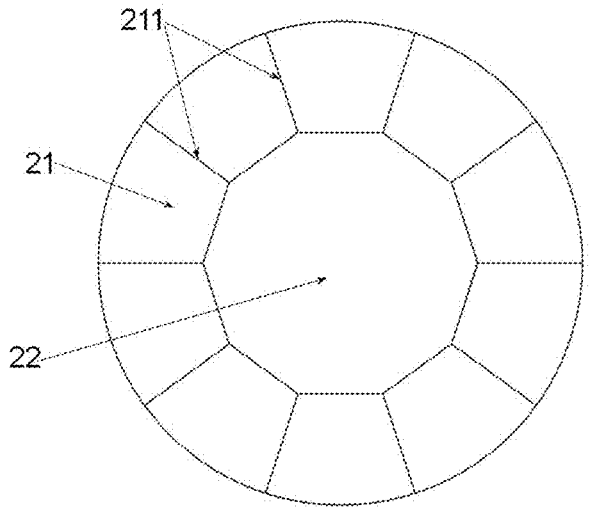
FGI. 7
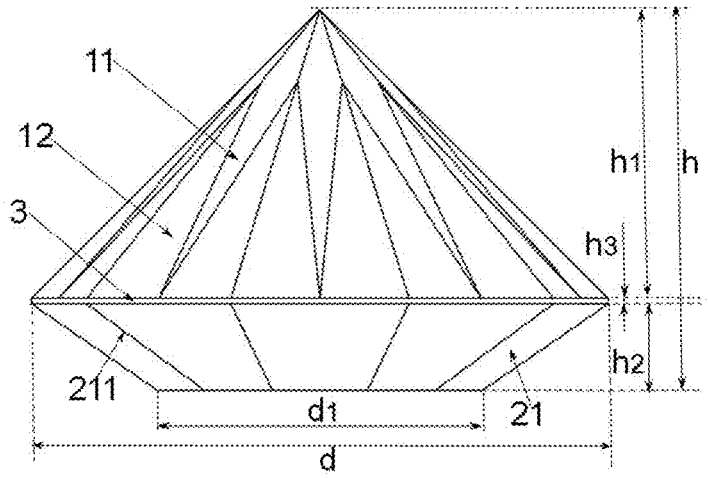
FIG. 8

DIAMOND WITH EIGHTY-ONE FACETS HAVING A TEN HEARTS AND TEN ARROWS INNER STRUCTURE AND A CUTTING METHOD THEREOF

CROSS-REFERENCE TO RELATED APPLICATIONS

This application is a continuation-in-part application of and claims the priority benefit of U.S. application Ser. No. 14/437,830 with 371(c) filing date of Apr. 22, 2015, now pending, which is a national phase application of International application No. PCT/CN2013/087111, filed on Nov. 14, 2013, which in turn claims the priority benefit of Chinese application No. 201310060336.2, filed on Feb. 26, 2013. The entirety of the above-mentioned patent applications are hereby incorporated by reference in their entirety.

TECHNICAL FIELD

The present invention relates to the field of jewelry, and more particularly, to a diamond with eighty-one facets having a ten hearts and ten arrows inner structure and a cutting method thereof.

BACKGROUND OF THE INVENTION

With the improvement of people's standard of living, the jewelries as people's ornaments are more and more widely used, in which the diamond jewelries are especially prominent. In a quality evaluation of the diamond, four aspects of color, clarity, carat, and cut are considered primarily. Because their English names all begin with the letter of "C", these four standards are called 4C for diamond. Because the color, clarity and carat are its own properties during diamond formation and cannot be altered, only cutting can endow the diamond with better quality and value and endow the diamond with more brilliant radiance.

The US application US2009/0056374A discloses a Gemstone Facet Configuration; the gemstone have a table facet 118, eight trapezoidal facets 120, eight irregular-hexagonal facets 122, eight irregular-pentagonal facets 124 and sixteen triangular crown-facets 126; the structure of the gemstone is irregular and the cutting ratio is not good enough.

The U.S. application D616,785S discloses a Round Cut, which has a table facet, twelve trapezoidal facets, twelve hexagonal facets, twelve pentagonal facets and twenty four triangular crown-facets. There are no cutting parameters of the gemstone for reference and the structure of the pavilion facet is quite simple.

SUMMARY OF THE INVENTION

The objective of the present application is to provide a diamond with eighty-one facets having a ten hearts and ten arrows inner structure and a cutting method thereof, aiming at obtaining a diamond with a ten hearts and ten arrows inner structure, and at the same time, improving the brilliance, fire and sparkle of the diamond.

The description of the present application is based on a structure of a diamond in the prior art, wherein the diamond has a crown, a pavilion and a girdle disposed between the crown and the pavilion; the crown has a table facet arranged horizontally; and, a facet of the girdle parallel to the table facet is a girdle facet. Therefore, the girdle facet herein is not a circumferential plane of the girdle but a horizontal plane vertical to the circumferential plane.

A first implementation of the present application provides a diamond with eighty-one facets having a ten hearts and ten arrows inner structure, comprising:

a table facet; and ten main crown facets and ten main pavilion facets, and each main crown facet is a hexagon which is symmetrical in a circumferential direction;

a crown star facet is disposed at a junction of two adjacent main crown facets with the table facet, the number of the crown star facets is ten, and each crown star facet is a trapezoid which is symmetrical in the circumferential direction;

a crown small facet is disposed at a junction of two adjacent main crown facets with the crown star facet, the number of the crown small facets is ten, and each crown small facet is a pentagon which is symmetrical in the circumferential direction;

a small sector is disposed at a junction of the main crown facet with the crown small facet, and the number of the small sectors is twenty; and two main pavilion facet auxiliary surfaces (hereinafter referred to as auxiliary surfaces) are disposed at a junction of two adjacent main pavilion facets, and the number of the auxiliary surfaces is twenty.

As a preferred implementation, an angle between the main crown facet and the girdle facet is 34-35°.

As a preferred implementation, an angle between the main pavilion facet and the girdle facet is 40.5-40.8°.

As a preferred implementation, an angle between the crown star facet and the table facet is 15.5-18.5°.

As a preferred implementation, a side shared by the crown small facet and the crown star facet is a short side of the crown small facet, a side shared by the main crown facet and the crown small facet is an edge of the crown small facet, referred to as a first edge, and an angle between the short side of the crown small facet and the first edge is 110°.

As a preferred implementation, the small sector presents almost a sector shape, and an angle between the small sector and the girdle facet is 35.5-36.5°.

As a preferred implementation, an angle between the auxiliary surface and the girdle facet is 42-42.3°.

A total height of the crown, the girdle and the pavilion of the diamond is a diamond height h, and a diameter of the pavilion facet of the pavilion of the diamond is a diamond diameter d.

As a preferred implementation, a roundness of the diamond is 99-100%.

As a preferred implementation, the diamond height h is 60.5% of the diamond diameter d.

As a preferred implementation, a diameter d1 of the table facet of the diamond is 56-57% of the diamond diameter d.

As a preferred implantation, a pavilion height h1 is 43.5-45% of the diamond diameter d, and a crown height h2 is 14.5-15.5% of the diamond diameter d.

As a preferred implementation, a girdle height h3 is 2.5% of the diamond diameter d.

A second implementation of the present invention provides a cutting method for a diamond with eighty-one facets having a ten hearts and ten arrows inner structure, which can cut the said diamond and comprises the following steps of:

(1) dividing a diamond blank into a pavilion, a crown and a girdle;

(2) pavilion cutting:

(2.1) cutting out the pavilion of the diamond; cutting the pavilion into ten main pavilion facets, wherein each main pavilion facet is in a sector shape, and an angle between the main pavilion facet and the girdle is 40.5-40.8°; each main pavilion facet has two main pavilion facet edges, and a bottom boundary line of the main pavilion facet, i.e., a first boundary line, is disposed at a junction of the main pavilion facet with the girdle; and (2.2) cutting out two main pavilion facet auxiliary surfaces at a junction of two adjacent main pavilion facets (i.e., on two sides of the main pavilion facet edge), wherein the number of the auxiliary surfaces is twenty; two adjacent auxiliary surfaces are formed between two adjacent main pavilion facets, the two auxiliary surfaces share one edge, and each auxiliary surface has an auxiliary surface edge sharing with the main pavilion facet; and, a bottom boundary line of the auxiliary surface (i.e., a second boundary line) is disposed at a junction of the auxiliary surface with the girdle; and (3) crown cutting:

(3.1) cutting out ten main crown facets on the crown of the diamond, wherein each main crown facet has two main crown facet edges, and two adjacent main crown facets share one main crown facet edge; and, each main crown facet is connected to the table facet and the girdle, and an angle between the main crown facet and the girdle is 34-35°;

(3.2) cutting out a crown star facet at a junction of two adjacent main crown facets with the table facet, wherein the number of the crown star facets is ten, each crown star facet is connected to the table facet and has two crown star facet waists;

(3.3) cutting out a crown small facet at a junction of two adjacent main crown facets and the crown star facet, wherein the number of the crown small facets is ten; each crown small facet is disposed between two adjacent main crown facets and between the crown star facet and the girdle; and the crown small facet has a short side of the crown small facet shared with the crown star facet, and two first edges; and (3.4) cutting out a small sector at a junction of the main crown facet and the crown small facet (i.e., on two sides of the first edge), wherein the number of the small sectors is twenty, each small sector is connected to the girdle, and each small sector has two small sector edges.

The main crown facet eventually obtained by the cutting method is a hexagon which is symmetrical in the circumferential direction, the crown star facet is a trapezoid which is symmetrical in the circumferential direction, and the crown small facet is a pentagon which is symmetrical in the circumferential direction.

In the cutting methods, the serial numbers are merely for distinguishing the cutting of each portion and not intended to limit the chronological order of cutting the pavilion and the crown.

As a preferred implementation, in the cut diamond, a projection (i.e., a first projection) of a symmetry axis of the main pavilion facet on the girdle facet is overlapped with a projection (i.e., a second projection) of a symmetry axis of the main crown facet on the girdle facet; and, a projection (i.e., a third projection) of the main pavilion facet edge on the girdle facet is overlapped with a projection (i.e., a fourth projection) of a symmetry axis of the crown small facet on the girdle facet.

As a preferred implementation, in the pavilion cutting, the second boundary line is 50% of the first boundary line.

As a preferred implementation, in the pavilion cutting, the length of the auxiliary surface edge is 75% of the length of the main pavilion facet edge.

As a preferred implementation, in the pavilion cutting, an angle between the auxiliary surface and the girdle facet is 42-42.3°.

As a preferred implementation, in the crown cutting, an angle between the crown star facet and the table facet is 15.5-18.5°.

As a preferred implementation, in the crown cutting, the length of the crown star facet waist is 50% of the length of the main crown facet edge.

As a preferred implementation, in the crown cutting, an angle between a short side of the crown small facet and the first edge is 110°.

As a preferred implementation, in the crown cutting, a height h4 of the crown small facet is 75% of a height h5 of the main crown facet edge.

As a preferred implementation, in the crown cutting, the small sector presents almost a sector shape, and an angle between the small sector and the girdle facet is 35.5-36.5°.

As a preferred implementation, in the crown cutting, a length of the small sector edge is 50% of a length of the first edge.

Compared with the prior art, the present application has the following beneficial effects.

(1) With the technical solutions of the present application, the diamond is cut into eighty-one facets, so that a ten hearts and ten arrows inner structure is formed. When the diamond of the present application is observed by an observation mirror, from the pavilion to the crown, a symmetrical ten-heart pattern with uniform saturation is presented, and the "hearts" are conspicuous and bright; and from the crown to the pavilion, a uniform and symmetrical ten-arrow structure is presented, and many radial bright facets are formed between one "arrow shaft" and another. With consistent brilliance and uniform color, the ten arrows and the ten hearts are integrated as a whole to form a perfect "ten hearts and ten arrows" optical effect.

(2) In the present application, by using a high-end cutting process, higher quality and value are given to the diamond, and the brilliance and sparkle of the diamond in the sunshine are improved. With the present application, the brilliance can be improved greatly in comparison to a conventional cutting technology, and the diamond is more brilliant.

BRIEF DESCRIPTION OF THE DRAWINGS

FIG. 7 is a first cutting graph of a crown;

FIG. 8 is a first schematic view of a combination of the crown and the pavilion;

Figure 1:
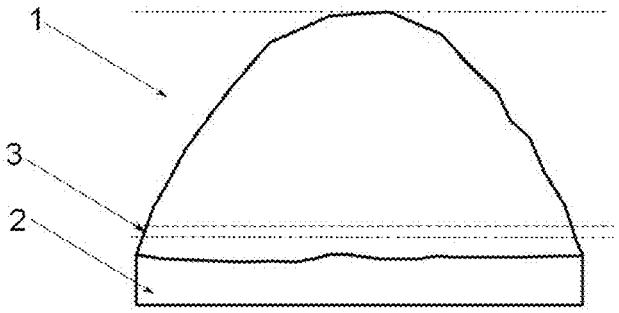
FIG. 1 is a schematic view of a diamond blank.

in which: 1 pavilion; 11 main pavilion facet; 111 main pavilion facet edge; 112 first boundary line; 12 main pavilion facet auxiliary surface; 121 second boundary line; 122 main pavilion facet auxiliary surface edge; 2 crown; 21 main crown facet; 211 main crown facet edge; 22 table facet; 23 crown star facet; 231 crown star facet waist; 24 crown small facet; 241 short side of the crown small facet; 242 first edge; 25 small sector; 251 small sector edge; 3 girdle; 31 girdle facet; 4 first projection; 5 second projection; 6 third projection; 7 fourth projection; 8 arrow; 9 heart.

DETAILED DESCRIPTION OF THE INVENTION

The technical solutions of the present application will be described below in detail by specific implementations. It should be understood that, without further description, elements, structures and features in one implementation can also be advantageously incorporated into other implementations.

It is to be noted that, in the descriptions of the present application, terms "first", "second" and the like are merely for illustrative purpose, and are not interpreted as indicating or implying relative importance. The implementations are merely preferred implementations of the present application and not intended to limit the scope of the present application. Various variations and improvements made to the technical solutions of the present application by a person of ordinary skill in the art without departing from the design spirit of the present application shall fall into the protection scope defined by the claims of the present application.

It is to be noted that, the description of the present application is based on a structure of a diamond in the prior art, wherein the diamond has a crown 2, a pavilion 1 and a girdle 3 located between the crown 2 and the pavilion 1; the crown 2 has a table facet 22 arranged horizontally; and, a facet of the girdle 3 parallel to the table facet 22 is a girdle facet 31. Therefore, the girdle facet 31 herein is not a circumferential plane of the girdle 3 but a horizontal plane vertical to the circumferential plane.

It should be understood that, in the cutting method of the present application, since the shape, side and other features of each facet is changing during the cutting, in order to ensure the description uniformity, the same term herein can refer to the shape or feature of the same structure in different cutting stages and can be relevantly interpreted with reference to the accompanying drawings.

1. Cutting Method

As shown in FIGS. 1-15, a cutting method for a diamond with eighty-one facets having a ten hearts and ten arrows inner structure is provided, comprising the following steps:

(1) As shown in FIG. 1, a diamond blank is divided into a pavilion 1, a crown 2 and a girdle 3 in accordance with its inherent shape. Generally, since the height of the pavilion 1 is larger than the height of the crown 2, the surface to be shaped of the diamond can be selected according to this characteristic during the division, so as to save the raw material and maximize the weight of the diamond.

Figure 2:
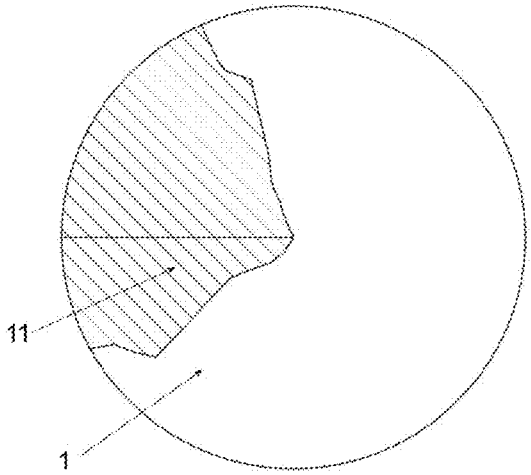
FIG. 2 is a first cutting graph of a pavilion.
Figure 3:
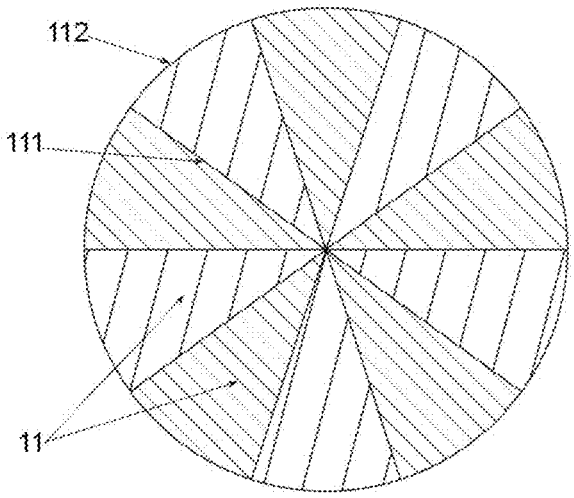
FIG. 3 is a second cutting graph of the pavilion.

(2) As shown in FIGS. 2-6, a cutting of the pavilion of the diamond specifically comprises the following steps:

As shown in FIGS. 2-3, ten main pavilion facets 11 are cut at the pavilion divided in the step 1. The main pavilion facets are in a sector shape.

Figure 16:
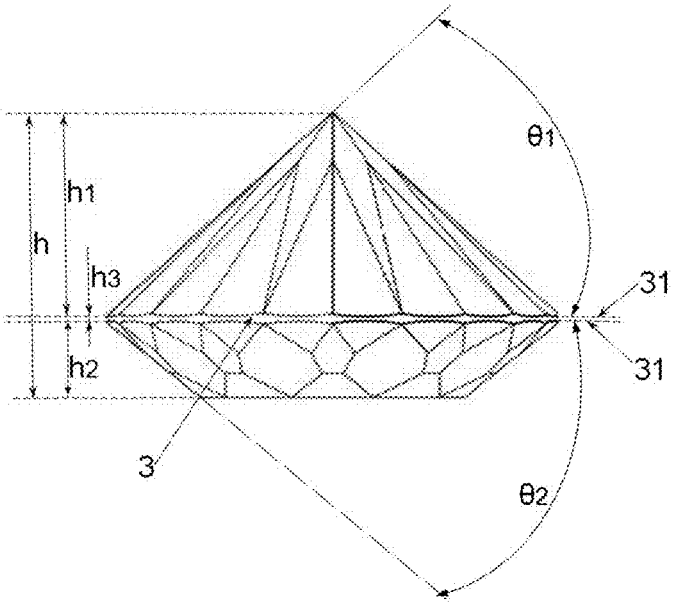
FIG. 16 is a first schematic view of a shaped diamond after cutting.

An angle θ1 between the main pavilion facet 11 and a girdle facet 31 is 40.5-40.8°, as shown in FIG. 16.

The girdle facet 31 is a horizontal plane perpendicular to the girdle 3, and is approximately parallel to the table facet described below.

As shown in FIG. 3, each main pavilion facet 11 has two main pavilion facet edges 111, and two adjacent main pavilion facets 11 share a same main pavilion facet edge 111. A first boundary line 112 is provided at a junction of the main pavilion facet 11 with the girdle 3.

Figure 4:
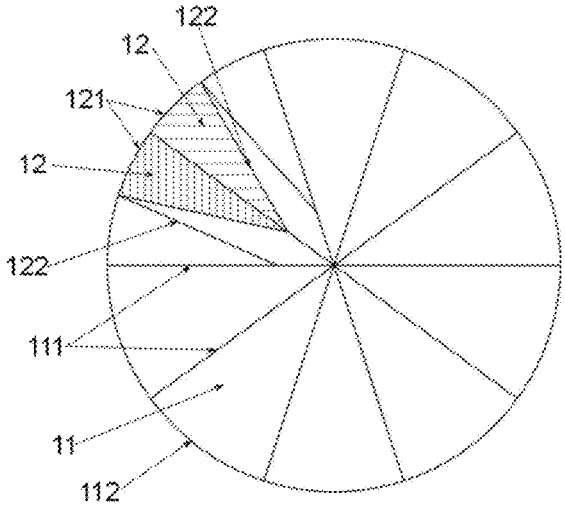
FIG. 4 is a third cutting graph of the pavilion.
Figure 5:
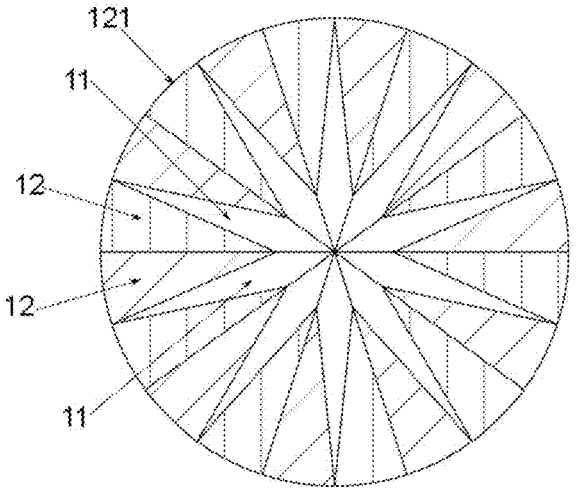
FIG. 5 is a fourth cutting graph of the pavilion.
Figure 6:
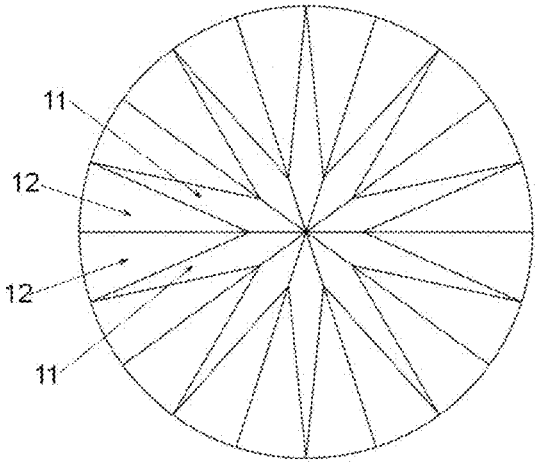
FIG. 6 is a schematic view of a shaped pavilion.

As shown in FIG. 4, two main pavilion facet auxiliary surfaces 12 are cut on two sides at a junction of two adjacent main pavilion facets 11, i.e., on two sides of the main pavilion facet edge 111. The number of the auxiliary surfaces 12 is twenty. The two adjacent auxiliary surfaces 12 share one edge, and each auxiliary surface 12 has an auxiliary surface edge 122 sharing with the main pavilion facet 11. A second boundary line 121 is provided at a junction of the auxiliary surface 12 with the girdle 3.

The length of the second boundary line 121 is 50% of the length of the first boundary line 112.

The length of the auxiliary surface edge 122 is 75% of the length of the main pavilion facet edge 111.

Figure 18:
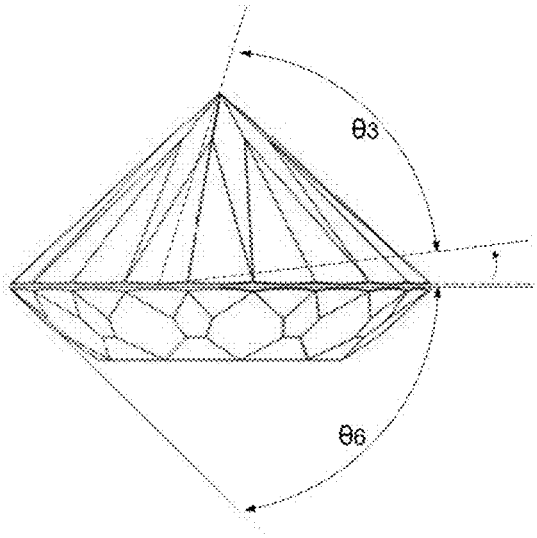
FIG. 18 is a third schematic view of the shaped diamond after cutting.

An angle θ3 between the auxiliary surface 12 and the girdle facet 31 is 42-42.3°, as shown in FIG. 18.

(3) As shown in FIGS. 7-15, a cutting of the crown of the diamond specifically comprises the following steps:

As shown in FIGS. 7 and 8, ten main crown facets 21 are cut at the crown 2 of the diamond. Each main crown facet 21 has two main crown facet edges 211, and two adjacent main crown facets 21 share one main crown facet edge 211. The main crown facets 21 are enclosed to form a table facet 22, and each main crown facet 21 is connected to both the table facet 22 and the girdle 3.

An angle θ2 between the main crown facet 21 and the girdle facet 31 is 34-35°, as shown in FIG. 16.

Figure 9:
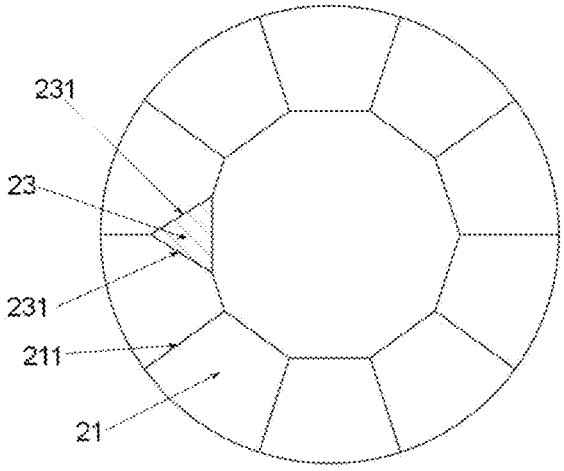
FIG. 9 is a second cutting graph of the crown.
Figure 10:
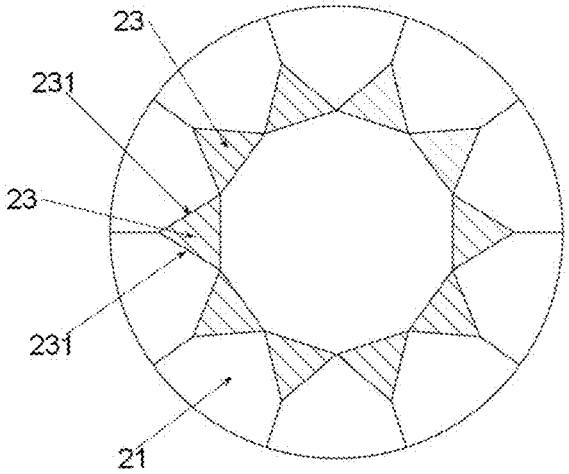
FIG. 10 is a third cutting graph of the crown.

As shown in FIGS. 9 and 10, a crown star facet 23 is cut at a junction of two adjacent main crown facets 21 with the table facet 22. The number of the crown star facets 23 is ten. Each crown star facet 23 is connected to the table facet 22 and has two crown star facet waists 231.

Figure 17:
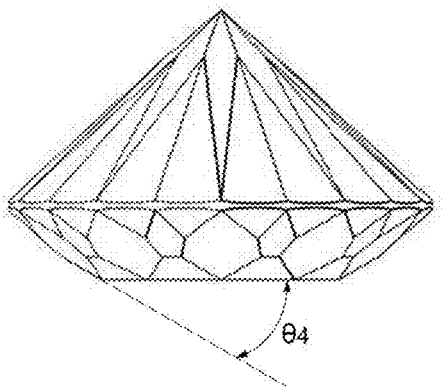
FIG. 17 is a second schematic view of the shaped diamond after cutting.

An angle θ4 between the crown star facet 23 and the table facet 22 is 15.5-18.5°, as shown in FIG. 17.

The length of the crown star waist 231 is 50% of the length of the main crown facet edge 211, as shown in FIG. 9.

Figure 11:
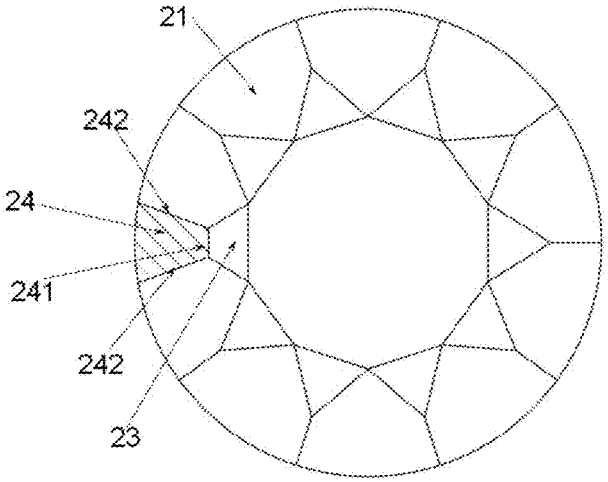
FIG. 11 is a fourth cutting graph of the crown.
Figure 12:
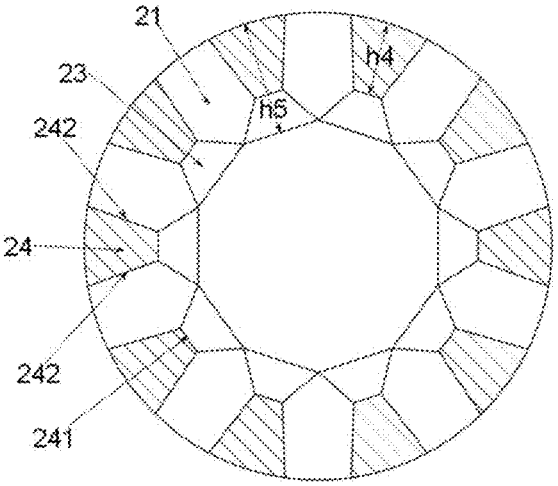
FIG. 12 is a fifth cutting graph of the crown.

As shown in FIGS. 11 and 12, a crown small facet 24 is cut at a junction of two adjacent main crown facets 21 with the crown star facet 23. The number of the crown small facets 24 is ten. Each crown small facet 24 is disposed between two adjacent main crown facets 21 and between the crown star facet 23 and the girdle 3. The crown small facet 24 has a short side 241 of the crown small facet shared with the crown star facet 23, and two first edges 242. Each first edge 242 is shared by the adjacent main crown facet 21.

Figure 15:
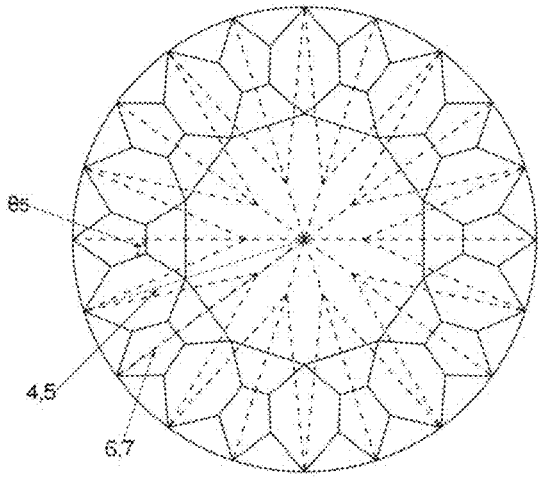
FIG. 15 is a second schematic view of a combination of the crown and the pavilion.

An angle θ5 between the short side 241 of the crown small facet and the first edge 242 is 110°, as shown in FIG. 15.

A height h4 of the crown small facet 24 is 75% of a height h5 of the main crown facet edge 211, as shown in FIG. 12.

Figure 13:
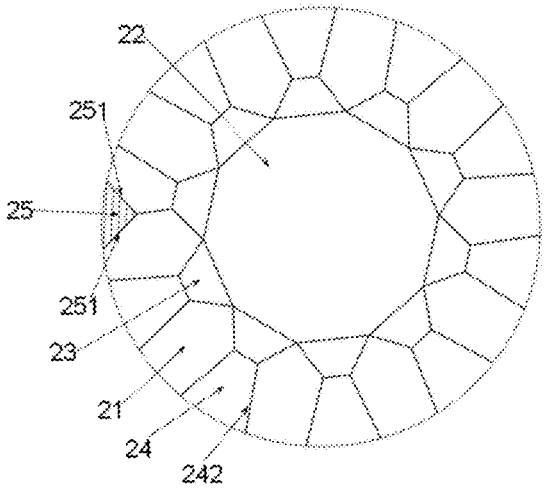
FIG. 13 is a sixth cutting graph of the crown.
Figure 14:
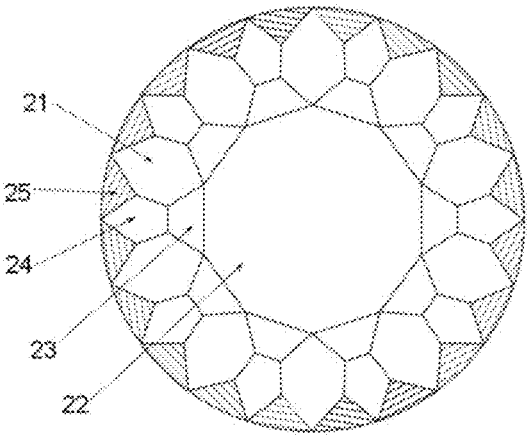
FIG. 14 is a seventh cutting graph of the crown.

As shown in FIGS. 13 and 14, a small sector 25 is cut at a junction of the main crown facet 21 with the crown small facet 24, i.e., on two sides of the first edge 242. The number of the small sectors 25 is twenty. Each small sector 25 is connected to the girdle 3, and each small sector 25 has two small sector edges 251.

The small sector 25 presents almost a sector shape, and an angle θ6 between the small sector 25 and the girdle facet 31 is 35.5-36.5°, as shown in FIG. 18.

A length of the small sector edge 251 is 50% of the length of the first edge 242.

By cutting the diamond blank, the eventually shaped diamond is almost round. Specifically, the girdle 31 is almost round. The main crown facets 21 are hexagons which are symmetrical in a circumferential direction, the crown star facets 23 are trapezoids which are symmetrical in the circumferential direction, and the crown small facets 24 are pentagons which are symmetrical in the circumferential direction; and, each small sector 25 has two small sector edges 251 and an arc connected to the girdle 3, and the small sector 25 presents almost a sector shape, as shown in FIGS. 14 and 15.

As shown in FIG. 15, in the shaped diamond, a projection (i.e., a first projection 4) of a symmetry axis of the main pavilion facet 11 on the girdle facet 31 is overlapped with a projection (i.e., a second projection 5) of a symmetry axis of the main crown facet 21 on the girdle facet 31.

A projection (i.e., a third projection 6) of the main pavilion facet edge 111 on the girdle facet 31 is overlapped with a projection (i.e., a fourth projection 7) of a symmetry axis of the crown small facet 24 on the girdle facet 31.

2. The Cut Diamond

As shown in FIG. 5, FIG. 6 and FIGS. 14-18, the diamond with eighty-one facets having a ten hearts and ten arrows inner structure obtained by the cutting method comprises:

a table facet 22; and ten main crown facets 21 and ten main pavilion facets 11, and each of the main crown facet 21 is a hexagon which is symmetrical in a circumferential direction;

a crown star facet 23 is disposed at a junction of two adjacent main crown facets 21 with the table facet 22, the number of the crown star facets 23 is ten, and each of the crown star facets 23 is a trapezoid which is symmetrical in the circumferential direction;

a crown small facet 24 is disposed at a junction of two adjacent main crown facets 21 with the crown star facet 23, the number of the crown small facets 23 is ten, and each of the crown small facet 24 is a pentagon which is symmetrical in the circumferential direction;

a small sector 25 is disposed at a junction of the main crown facet 21 with the crown small facet 24, and the number of the small sectors 25 is twenty; and two main pavilion facet auxiliary surfaces 12 are disposed at a junction of the two adjacent main pavilion facets 11, and the number of the auxiliary surfaces 12 is twenty.

(1) About the Crown:

An angle θ2 between the main crown facet 21 and the girdle facet 31 is 34-35°, as shown in FIG. 16.

An angle θ4 between the crown star facet 23 and the table facet 22 is 15.5-18.5°, as shown in FIG. 17.

A side shared by the crown small facet 24 and the crown star facet 23 is a short side 241 of the crown small facet, a side shared by the main crown facet 21 and the crown small facet 24 is a first edge 242, and an angle θ5 between the short side 241 and the first edge 242 is 110°, as shown in FIG. 15.

The small sector 25 presents almost a sector shape, and an angle θ6 between the small sector 25 and the girdle facet 31 is 35.5-36.5°, as shown in FIG. 18.

(2) About the Pavilion:

An angle θ1 between the main pavilion facet 1 and the girdle facet 31 is 40.5-40.8°, as shown in FIG. 16.

An angle θ3 between the auxiliary surface 12 and the girdle facet 31 is 42-42.3°, as shown in FIG. 18.

(3) Others

As shown in FIGS. 8 and 16, a total height of the diamond is a diamond height h, the pavilion height is h1, the crown height is h2, the girdle height is h3, and the diameter of a girdle facet 31 of the girdle 3 of the diamond is a diamond diameter d.

The roundness of the diamond is 99-100%.

The diamond height h is 60.5% of the diamond diameter d.

The diameter d1 of the table facet is 56-57% of the diamond diameter d.

The pavilion height h1 is 43.5-45% of the diamond diameter d. The crown height h2 is 14.5-15.5% of the diamond diameter d. The girdle height h3 is 2.5% of the diamond diameter d.

The position of a tip of the pavilion of the diamond is a central position, and the deviation should be less than 1%.

3. Measurement, Comparison and Analysis Embodiments

To describe the effect of the diamond of the present application, the present application provides three embodiments within the scope of the present application and six comparison examples; specifically, The shapes and parameter ranges in the embodiments fall into the protection scope of the present application.

The comparison examples 1-4 have the same shape as that in the present application, but have different parameter ranges.

The comparison example 5 employs the graphs and parameters in FIGS. 2B and 2C in U.S. Publication No. US 2009/0056374A. When the original application document does not provide parameters, the comparison example 5 employs the same parameters as Embodiment 2.

The comparison example 6 employs the shape provided by U.S. Design Pat. No. D616,785S, but the cutting parameters are the same as those in Embodiment 2.

(1) Cutting Parameters

For the diamonds provided in the embodiments and the comparison examples, the following same parameters are employed (except the existing parameters in the comparison examples 5 and 6): the roundness of the diamond is 99%; h/d=60.50%; d1/d=56%; h1/h=44%; h2/h=15%; h3/h=2.5%; θ3=42°; θ5=110°; the length of the small sector edge is 50% of the length of the first edge; the length of the second boundary line is 50% of the first boundary line; and, the length of the main pavilion facet auxiliary surface edge is 75% of the length of the main pavilion facet edge.

Other parameters refer to Table 1.

TABLE 1

Parameters of diamonds

| | Proportion of the length of the crown star facet waist in the length of the main crown facet | θ4 | h4/h5 | θ6 | θ1 | θ2 |
|---|---|---|---|---|---|---|
| Embodiment 1 | 50% | 17° | 75% | 36° | 40.5° | 34° |
| Embodiment 2 | 50% | 17° | 75% | 36° | 40.6° | 34.5° |
| Embodiment 3 | 50% | 17° | 75% | 36° | 40.8° | 35° |
| Comparison example 1 | 50% | 17° | 75% | 36° | 40.5° | 33° |

TABLE 1-continued

| Parameters of diamonds | | | | | | |
|---|---|---|---|---|---|---|
| | Proportion of the length of the crown star facet waist in the length of the main crown facet | θ4 | h4/h5 | θ6 | θ1 | θ2 |
| Comparison example 2 | 50% | 17° | 75% | 36° | 50° | 35° |
| Comparison example 3 | 40% | 17° | 70% | 36° | 40.6° | 34.5° |
| Comparison example 4 | 50% | 15° | 75% | 37° | 40.6° | 34.5° |
| Comparison example 5 | 50% | 16° | 75% | 34° | 41° | 28° |
| Comparison example 6 | 50% | 17° | 75% | 36° | 40.6° | 34.5° |

(2) Test Data and Results 2.1 Comparison and Analysis of Tests on Brilliance, Fire and Sparkle In the tests, the brilliance, fire and sparkle of the diamonds in the embodiments and the comparison examples are analyzed. The test conditions are as follows: first, the cutting level is above Very Good; second, the diamond specification is within a range of 0.50 ct to 0.59 ct; and, third, the testing environment is a same light source and a same detection instrument being used, wherein the brilliance, fire and sparkle of the diamonds in the comparison examples 1-4 are far less than those of the diamonds in Embodiments 1-3 of the present application, and various indexes of the diamonds in the comparison examples 1-4 are at least less about 10-15% than those of the diamonds in Embodiments 1-3 and a description will not be repeated here.

In order to better compare the diamond of the present application and the diamond in the prior art in terms of brilliance, fire and sparkle, the present application focuses on the comparison and analysis of the tests on Embodiment 2, Comparison Example 5 and Comparison Example 6 having similar cutting parameters. The results of measurement refer to FIGS. 19-21 and Table 2.

TABLE 2

| Comparison in brilliance, fire and sparkle | | | |
|---|---|---|---|
| Test item | Embodiment 2 | Comparison example 5 | Comparison example 6 |
| Brilliance | 67.85 | 55.96 | 50.41 |
| Fire | 87.80 | 75.87 | 86.16 |
| Sparkle | 208.58 | 147.90 | 152.77 |

Figure 19:
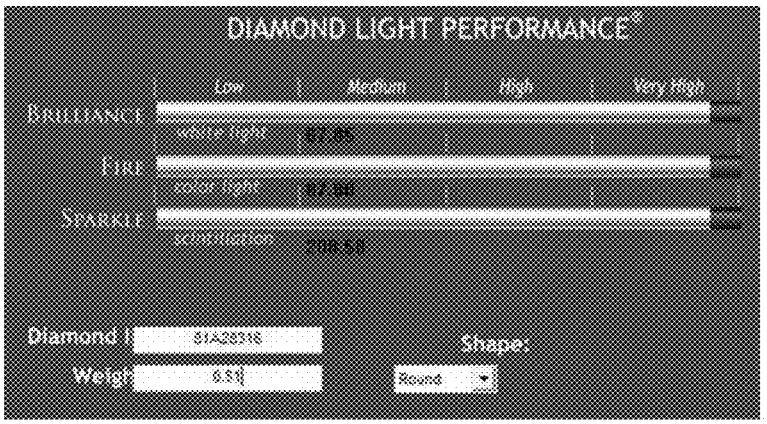
FIG. 19 is a measurement view of Embodiment 2.
Figure 20:
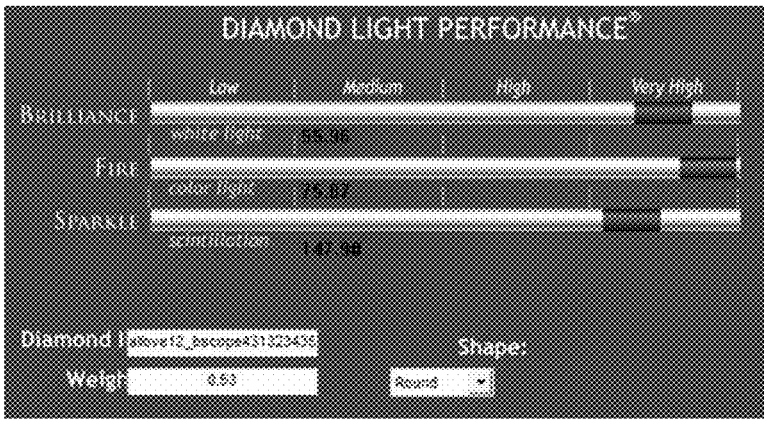
FIG. 20 is a measurement view of Comparison example 5.
Figure 21:
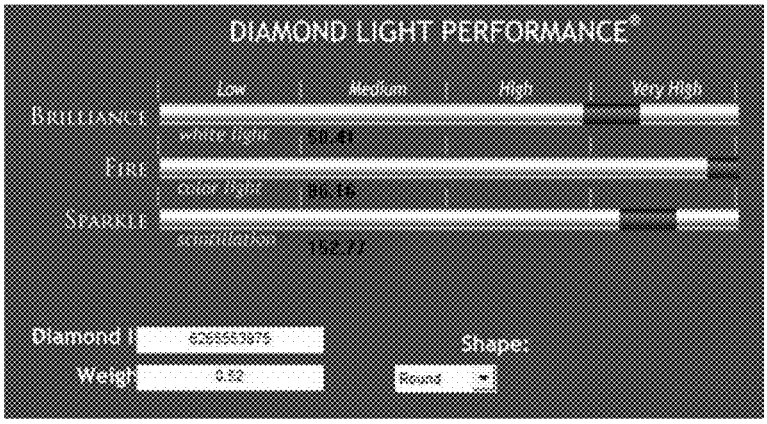
FIG. 21 is a measurement view of Comparison example 6.

It can be seen from FIGS. 19-21 and Table 2 that, the brilliance, fire and sparkle of diamonds are substantially within the range of "Very High". However, the brilliance, fire and sparkle of the diamond in the Comparison Example 5 are less about 17.5%, 13.4% and 29.1% than those of the diamond in Embodiment 2, respectively, wherein the calculation method is as follows: (Embodiment 2-Comparison Example 5)/Embodiment 2; and, the brilliance, fire and sparkle of the diamond in the comparison example 6 are less about 25.7%, 1.9% and 26.8% than those of the diamond in Embodiment 2, respectively, wherein the calculation method is as follows: (Embodiment 2-Comparison Example 6)/Embodiment 2. Hence, the diamond of the present application has obvious advantages in terms of brilliance, fire and sparkle.

The inventor(s) considers (consider) that, since the diamond is composed of substances having high ability to transmit and reflect light, the principles of light reflection, refraction, transmission and the like inside the diamond are quite complicated; and, even by small adjusting of the cutting parameters such as side length and angle, the brilliance, fire and sparkle of the diamond will be changed greatly. Thus, it is difficult to control the adjustment range.

2.2. Optical Effect Views of Ten Hearts and Ten Arrows

Figure 22:
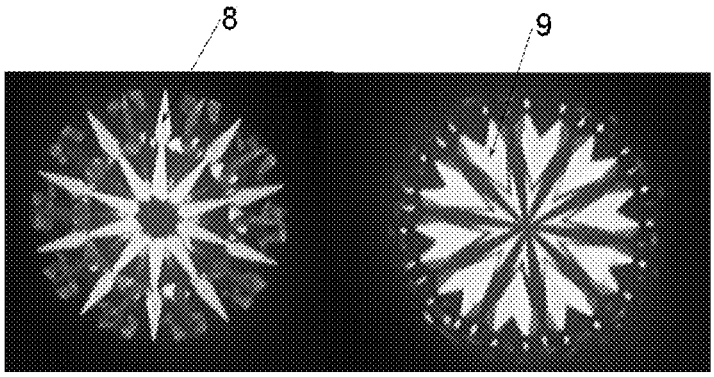
FIG. 22 is an optical effect view of Embodiment 2.
Figure 23:
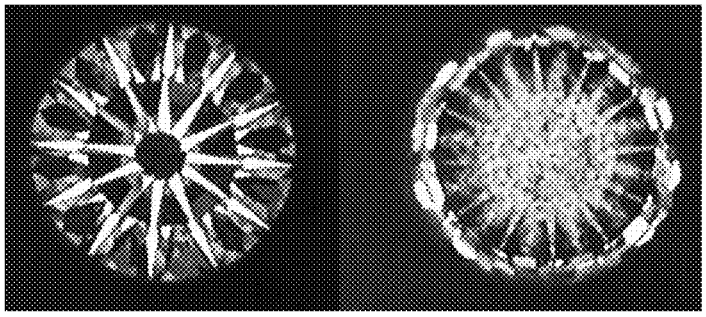
FIG. 23 is an optical effect view of Comparison example 6.

Since the parameters and shape of the diamond of the present invention is particularly close to those of the diamond in the Comparison Example 6 (with 12 main crown facets), the two diamonds in Embodiment 2 and the Comparison Example 6 are further observed by a lathe mirror to obtain the optical effect views shown in FIGS. 22 and 23. It can be seen from FIG. 22 that, for the diamond in Embodiment 2, when observed from the crown to the pavilion (left view), a symmetrical "ten-arrow" structure with uniform size and clear outline is presented; and, when observed from the pavilion to the crown (right view), a symmetrical "ten-heart" structure with uniform size and clear outline is presented. It can be seen from FIG. 23 that, for the diamond in the Comparison Example 6, a "ten-arrow" structure can be realized, but the degree of distinction of the arrows is low; moreover, when observed from the pavilion to the crown (right view), the image is in a radial pattern, and a "ten-heart" structure cannot be realized.

Since the outline of the presented "ten hearts and ten arrows" structure of the diamond obtained by the cutting parameters out of the range of the present application is not clear enough and the emitted rays are disperse, the grade of the obtained diamond is not so good.

What is claimed is:

1. A diamond with eighty-one facets having a ten hearts and ten arrows inner structure, said eighty-one facets consisting of:

a table facet; and ten main crown facets and ten main pavilion facets, and each main crown facet is a hexagon which is symmetrical in a circumferential direction;

a crown star facet is disposed at a junction of two adjacent main crown facets with the table facet, the number of the crown star facets is ten, and each crown star facet is a trapezoid which is symmetrical in the circumferential direction;

a crown small facet is disposed at a junction of two adjacent main crown facets with the crown star facet, the number of the crown small facets is ten, and each crown small facet is a pentagon which is symmetrical in the circumferential direction;

a small sector is disposed at a junction of the main crown facet with the crown small facet, and the number of the small sectors is twenty;

two main pavilion facet auxiliary surfaces are disposed at a junction of two adjacent main pavilion facets, and the number of the auxiliary surfaces is twenty;

wherein an angle between the main crown facet and a girdle facet is 34-35°; and, wherein an angle between the main pavilion facet and the girdle facet is 40.5-40.8°.

2. The diamond according to claim 1, wherein an angle between the crown star facet and the table facet is 15.5-18.5°.

3. The diamond according to claim 2, wherein a projection of a symmetry axis of the main pavilion facet on the girdle facet is overlapped with a projection of a symmetry axis of the main crown facet on the girdle facet; and, a projection of the main pavilion facet edge on the girdle facet is overlapped with a projection of a symmetry axis of the crown small facet on the girdle facet.

4. The diamond according to claim 2, wherein a side shared by the crown small facet and the crown star facet is a short side of the crown small facet, a side shared by the main crown facet and the crown small facet is an edge of the crown small facet, referred to as a first edge, and an angle between the short side and the first edge is 110°.

5. The diamond according to claim 4, wherein the small sector presents almost a sector shape, and an angle between the small sector and the girdle facet is 35.5-36.5°.

6. The diamond according to claim 5, wherein a projection of a symmetry axis of the main pavilion facet on the girdle facet is overlapped with a projection of a symmetry axis of the main crown facet on the girdle facet; and, a projection of the main pavilion facet edge on the girdle facet is overlapped with a projection of a symmetry axis of the crown small facet on the girdle facet.

7. The diamond according to claim 1, wherein the small sector presents almost a sector shape, and an angle between the small sector and the girdle facet is 35.5-36.5°.

8. The diamond according to claim 1, wherein an angle between the auxiliary surface and the girdle facet is 42-42.3°.

9. The diamond according to claim 1, wherein a pavilion height h1 is 43.5-45% of a diamond diameter d; a crown height h2 is 14.5-15.5% of the diamond diameter d; and a girdle height h3 is 2.5% of the diamond diameter d.

10. The diamond according to claim 1, wherein a roundness of the diamond is 99-100%; a diamond height h is 60.5% of the diamond diameter d; and a diameter d1 of the table facet is 56-57% of the diamond diameter d.

* * * * *